US012029317B2

(12) United States Patent
Li

(10) Patent No.: US 12,029,317 B2
(45) Date of Patent: Jul. 9, 2024

(54) TRIM, VERTICAL BEAM ASSEMBLY AND SHELVING SYSTEM

(71) Applicant: HANGZHOU GREAT STAR INDUSTRIAL CO., LTD., Hangzhou (CN)

(72) Inventor: Yueming Li, Hangzhou (CN)

(73) Assignee: HANGZHOU GREAT STAR INDUSTRIAL CO., LTD., Hangzhou (CN)

( * ) Notice: Subject to any disclaimer, the term of this patent is extended or adjusted under 35 U.S.C. 154(b) by 114 days.

(21) Appl. No.: 17/295,649

(22) PCT Filed: Apr. 1, 2021

(86) PCT No.: PCT/CN2021/084826
§ 371 (c)(1),
(2) Date: May 20, 2021

(87) PCT Pub. No.: WO2022/165968
PCT Pub. Date: Aug. 11, 2022

(65) Prior Publication Data

US 2022/0248851 A1 Aug. 11, 2022

(30) Foreign Application Priority Data

Feb. 5, 2021 (CN) ..... 202110162623.9

(51) Int. Cl.
*A47B 96/20* (2006.01)

(52) U.S. Cl.
CPC ..... *A47B 96/20* (2013.01); *A47B 2096/209* (2013.01)

(58) Field of Classification Search
CPC ... A47B 96/20; A47B 2096/209; A47F 5/103; E04F 19/02; E04F 19/026
See application file for complete search history.

(56) References Cited

U.S. PATENT DOCUMENTS 3,532,212 A * 10/1970 Toth ..... A47B 57/42 206/343
4,055,318 A * 10/1977 Duckett ..... F16B 12/02 403/231

(Continued)

FOREIGN PATENT DOCUMENTS

CN 104590797 A 5/2015
CN 109892853 A 6/2019

(Continued)

OTHER PUBLICATIONS

CNIPA; Decision of Rejection, Aug. 5, 2021, 2 pages, (with English translation).

(Continued)

*Primary Examiner* — Ko H Chan
(74) *Attorney, Agent, or Firm* — Fitch, Even, Tabin & Flannery, LLP

(57) ABSTRACT

A trim is used for being covered on a vertical beam of a shelving system, wherein the trim is matched with the shape of the vertical beam, and the trim is configured such that when the trim is covered on the vertical beam, a force is generated between the trim and the vertical beam, the trim is fixed on the vertical beam with the force and the trim is covered on at least part of the surface of the vertical beam. A vertical beam assembly comprises a vertical beam and a trim which is covered on the vertical beam. A shelving system comprises a horizontal beam and a vertical beam which contains a magnetic trim. The connection mode between the trim and the vertical beam is very convenient for installation and disassembly. The trim is covered on the vertical beam, which may improve the overall aesthetics of the vertical beam and prevent other items from being hooked on the vertical beam and thus causing damage to the shelving system.

13 Claims, 12 Drawing Sheets

(56) References Cited

U.S. PATENT DOCUMENTS

| | | | | |
|---|---|---|---|---|
| 4,250,596 | A * | 2/1981 | Hara | B29C 66/126 52/309.3 |
| 4,966,343 | A * | 10/1990 | Bessinger | A47B 57/42 211/187 |
| 6,128,862 | A * | 10/2000 | Katz | A47B 35/00 52/2.25 |
| 6,196,141 | B1 * | 3/2001 | Herron, III | A47B 95/008 211/187 |
| 6,381,910 | B1 * | 5/2002 | Katz | E04G 21/30 52/211 |
| 6,644,609 | B1 * | 11/2003 | Scott | A47B 96/1458 248/909 |
| 7,219,392 | B2 * | 5/2007 | Mullet | E05D 15/24 16/96 R |
| D660,984 | S | 5/2012 | Kotin | |
| 8,434,629 | B2 * | 5/2013 | Fernandez | A47B 96/067 211/94.01 |
| D723,716 | S | 3/2015 | Imus | |
| 10,477,988 | B2 * | 11/2019 | Bryan | A47F 13/00 |
| 10,610,016 | B2 * | 4/2020 | Nilsson | A47B 57/16 |
| 11,426,000 | B2 * | 8/2022 | Klacking | A47B 97/00 |
| 2003/0170594 | A1 * | 9/2003 | Anderson | B44C 1/10 434/80 |
| 2005/0284586 | A1 * | 12/2005 | Mullet | E05D 15/24 160/201 |
| 2007/0089819 | A1 * | 4/2007 | Zenkich | A47F 5/0043 150/158 |
| 2008/0263915 | A1 * | 10/2008 | Wardell | G09F 7/04 40/1 |
| 2009/0173021 | A1 * | 7/2009 | Katz | A47B 35/00 52/211 |
| 2012/0082819 | A1 | 4/2012 | Sterling et al. | |

FOREIGN PATENT DOCUMENTS

| | | | |
|---|---|---|---|
| CN | 211154632 | U | 8/2020 |
| EP | 0539957 | A1 | 5/1993 |

OTHER PUBLICATIONS

USPTO; Office Action from U.S. Appl. No. 29/802,138; mailed Dec. 22, 2023 (28 pages).

* cited by examiner

TRIM, VERTICAL BEAM ASSEMBLY AND SHELVING SYSTEM

CROSS-REFERENCE TO RELATED APPLICATIONS

This application is a U.S. national phase application of International Application No. PCT/CN2021/084826, filed Apr. 1, 2021, which claims priority to Chinese Patent Application No. 202110162623.9, filed Feb. 5, 2021.

FIELD OF THE INVENTION

The present application relates to an item storage assembly, and in particular to a trim, a vertical beam assembly using the trim, and a shelving system.

DESCRIPTION OF THE PRIOR ART

At present, in the warehousing field, item storage assemblies are usually used to store items to improve space utilization. Common item storage assemblies are usually frame structures composed of horizontal beams and vertical beams, and suspension elements such as brackets and baskets are connected to the vertical beams. A common vertical beam is shown in FIG. 1, of which the cross-section is generally U-shaped, comprising a front panel and first and second side surfaces that are interconnected with the front panel, the first and second side surfaces being oppositely provided. A plurality of slotted holes are provided on the front panel for connecting the suspension elements. In order to enhance the strengths of the item storage assemblies, the vertical beams and the suspension elements are usually made of metal. In the process of installing the suspension elements, the noise between the suspension elements and the vertical beams due to collision and friction will cause discomfort to users. In addition, in order to expand the applicable scope of the vertical beam, there are usually a large number of slotted holes arranged on the front panel of the vertical beam to adapt to different installation heights. Generally, only a small number of slotted holes are used to install the suspension elements, and the remaining slotted holes are in a vacant state, which affects the overall aesthetics of the item storage assembly.

Therefore, those skilled in the art devote themselves to developing a trim that can be covered on a vertical beam to suppress the noise caused by contact and collision between a suspension element and the vertical beam, and to shield slotted holes on the vertical beam to improve the aesthetics.

SUMMARY OF THE INVENTION

In order to achieve the above objectives, the present application provides a trim for being covered on a vertical beam, wherein the trim is matched with the shape of the vertical beam, and the trim is configured such that when the trim is covered on the vertical beam, a force is generated between the trim and the vertical beam, the trim is fixed on the vertical beam with the force and the trim is covered on at least part of the surface of the vertical beam.

In some embodiments, optionally, the trim is an injection molded piece containing magnetic powders.

In some embodiments, optionally, the trim comprises a body, wherein the body is in a long strip shape, the shape of the body is matched with a front panel, with slotted holes, of the vertical beam, and the body is configured to be covered on the front panel of the vertical beam.

In some embodiments, optionally, the body comprises a first surface and a second surface that are oppositely provided, the width of the first surface is greater than the width of the second surface, and the first surface is configured to be in contact with the front panel of the vertical beam.

In some embodiments, optionally, the trim further comprises at least one wing edge, one of the at least one wing edge is provided on one side of the body along the length direction of the body, the wing edge is connected to the body through a first connecting portion, and the wing edge is configured to be able to rotate around the first connecting portion relative to the body.

In some embodiments, optionally, the trim has an unfolded state and a folded state, in the unfolded state, the wing edge is flush with the body; in the folded state, the wing edge and the body form an angle, and the wing edge is configured to be covered on a side surface of the vertical beam.

In some embodiments, optionally, the first connecting portion is V-shaped, and the thickness of the first connecting portion is less than the thickness of the body and the thickness of the wing edge.

In some embodiments, optionally, the at least one wing edge comprises a first wing edge and a second wing edge, and the first wing edge and the second wing edge are respectively located on two opposite sides of the body along the length direction.

In some embodiments, optionally, the trim further comprises a first side edge and a second side edge, the first side edge and the second side edge are respectively connected to two opposite sides of the body along its length direction, and the first side edge and the second side edge are respectively connected to the body through second connecting portions.

In some embodiments, optionally, the second connecting portions are in arc shapes.

In some embodiments, optionally, the trim is provided with at least one first tear line, the first tear line is perpendicular to the length direction of the trim, and the trim is configured to be able to be broken along the first tear line under the action of an external force.

In some embodiments, optionally, the trim is provided with at least one second tear line, the second tear line is parallel to the length direction of the trim, and the trim is configured to be able to be broken along the second tear line under the action of an external force.

In some embodiments, optionally, at least part of the trim is made of a magnetic material.

In some embodiments, optionally, the trim is provided with a plurality of magnetic portions, and the magnetic portions are made of magnetic materials.

In some embodiments, optionally, the trim has elasticity, and the trim is configured to be deformed when it comes into contact with the vertical beam, thereby generating an elastic force, and the elastic force causes the trim to be clamped on the vertical beam.

In some embodiments, optionally, the trim comprises a body, a first side edge and a second side edge, wherein the first side edge and the second side edge are respectively connected to two opposite sides of the body along its length direction, and the first side edge and the second side edge are configured such that the spacing between the two side edges changes under the action of an external force, and the spacing between the two side edges returns to an original state when the external force disappears.

In some embodiments, optionally, the trim is flexible, and the trim is configured to be able to be rolled up to form a cylinder.

The present application also provides a vertical beam assembly, comprising:

a vertical beam which comprises a front panel and two side surfaces, wherein the two side surfaces are respectively located on two opposite sides of the front panel along its length direction, such that the cross-section of the vertical beam is U-shaped; and a trim which is covered on at least part of the surface of the vertical beam, wherein the trim is configured such that by using a force generated by contact between the trim and the vertical beam, the trim is fixed on the vertical beam.

In some embodiments, optionally, at least part of the trim is made of a magnetic material.

In some embodiments, optionally, the trim has elasticity, and the trim is configured to be deformed when it comes into contact with the vertical beam, thereby generating an elastic force, and the elastic force causes the trim to be clamped on the vertical beam.

The present application also provides a shelving system, comprising:

a horizontal beam;

a vertical beam which is connected to the horizontal beam; and a trim which is covered on at least part of the surface of the vertical beam, wherein at least part of the trim contains a magnetic material, such that the trim is fixed on the vertical beam by a magnetic force generated by contact between the trim and the vertical beam.

Compared with the prior art, the beneficial effects of the technical solutions of the present application are as follows:

1. A trim is fixed on a vertical beam by a force generated by its contact with the vertical beam. For example, the trim is made of a material containing magnetic components, and when it comes into contact with the vertical beam, a magnetic force is generated, such that the trim is attracted to the vertical beam; or the trim has elasticity, and when the trim comes into contact with the vertical beam, the trim is deformed to generate an elastic force, and the trim is clamped on the vertical beam by the elastic force. The connection mode between the trim and the vertical beam is very convenient for installation and disassembly.

2. The trim is covered on the vertical beam, which can reduce the noise caused by contact and collision between a suspension element and the vertical beam, and avoid causing discomfort to users.

3. The trim shields slotted holes on the vertical beams, which improves the overall aesthetics of the vertical beam.

4. The trim can be made of a flexible material, thus being convenient for being rolled up, and convenient for storage and transportation.

100—vertical beam, 101—front panel, 102—first side surface, 103—second side surface, 104—slotted hole, 200—trim, 201—body, 202—first surface, 203—second surface, 204—rounded corner, 205—first tear line, 206—second tear line, 207—wing edge, 208—first connecting portion, 209—first side edge, 210—second side edge, 211—second connecting portion, 212—magnetic portion, 213—suction component.

DETAILED DESCRIPTION OF THE PREFERRED EMBODIMENTS

Hereinafter, preferred embodiments of the present application will be introduced with reference to the drawings attached to the specification, so that the technical content will be clearer and easier to understand. The present application can be embodied in many different forms of embodiments, and the scope of protection of the present application is not limited to the embodiments mentioned herein.

Hereinafter, the concept, specific structure and technical effects of the present application will be further illustrated, so as to fully understand the purposes, features and effects of the present application, but the protection of the present invention is not limited thereto.

Figure 1:
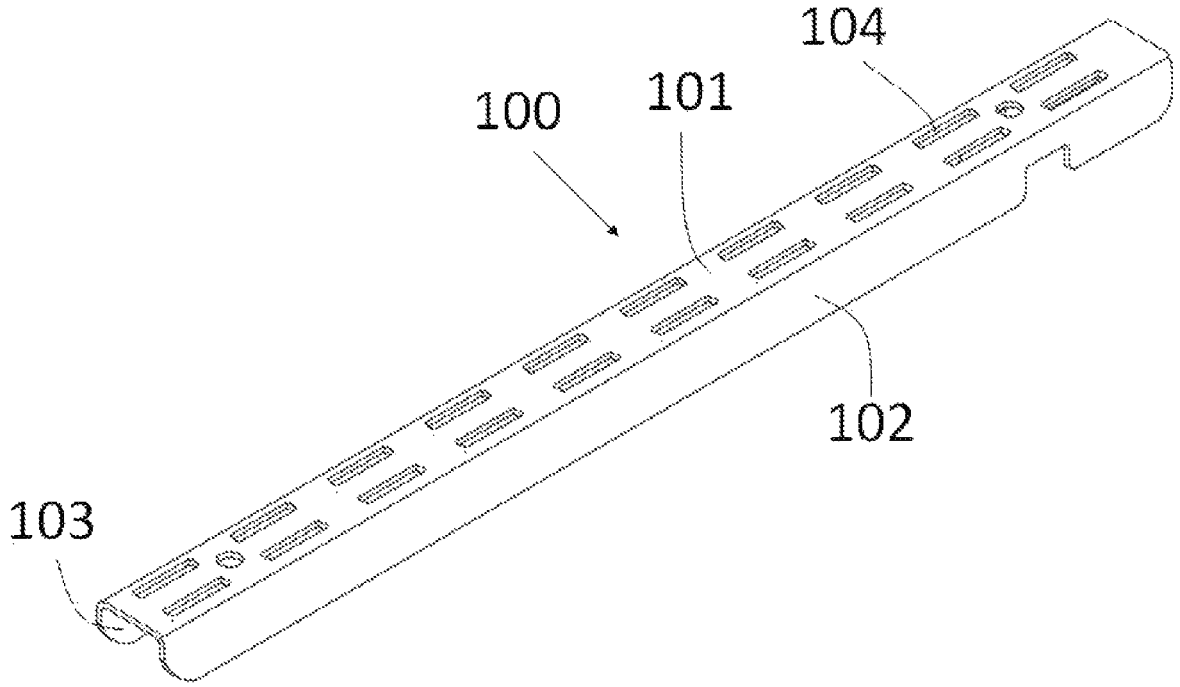
FIG. 1 is a structural view of a vertical beam in the prior art.

As shown in FIG. 1, a vertical beam 100 commonly used in the prior art is shown. The vertical beam 100 is in a long strip shape as a whole and is generally vertically provided. When the vertical beam 100 is vertically provided, the length direction of the vertical beam is defined as an up-down direction or a vertical direction, and the horizontal direction perpendicular to the length direction of the vertical beam 100 is a transverse direction. The vertical beam 100 comprises a front panel 101, and a first side surface 102 and a second side surface 103 that are interconnected with the front panel 101, and the first side surface and the second side surface are oppositely provided, such that the cross-section of the vertical beam 100 is substantially U-shaped. A plurality of slotted holes 104 are provided on the front panel 101 of the vertical beam 100. These slotted holes 104 can be arranged side by side in two rows along the length direction of the vertical beam 100, or they can be arranged in a staggered manner along the length direction of the vertical beam 100, or any arrangement in the prior art is used. These slotted holes 104 are used to connect suspension elements such as brackets and baskets. The suspension elements can be connected to the vertical beam 100 in any known manner. For example, the suspension elements can be fixed to the slotted holes 104 by fasteners, or can be hung on the slotted holes 104 by providing hooks on the suspension elements. It should be understood that the vertical beam 100 shown in FIG. 1 is only an example applicable to the present application, and its specific structure does not constitute a limitation to the present application, and other existing vertical beam structures in the prior art can also be applied to the technical solutions of the present application.

After a user finishes installing the shelving system, unused slotted holes 104 on the vertical beam 100 will be exposed. The present application provides a trim 200, and the user can select a desired trim 200 according to the size of the exposed slotted holes 104, so as to shield the exposed slotted holes 104. By doing so, the aesthetics of the product may be increased. In addition, if the slotted holes 104 are not shielded, other items may enter the vertical beam 100 through the slotted holes 104. In particular, some items may be hooked on the vertical beam 100, which will destroy the whole shelving system when the items are pulled. By providing the trim 200 to shield the unused slotted holes 104, the above situation can be avoided.

Embodiment 1

Figure 2:
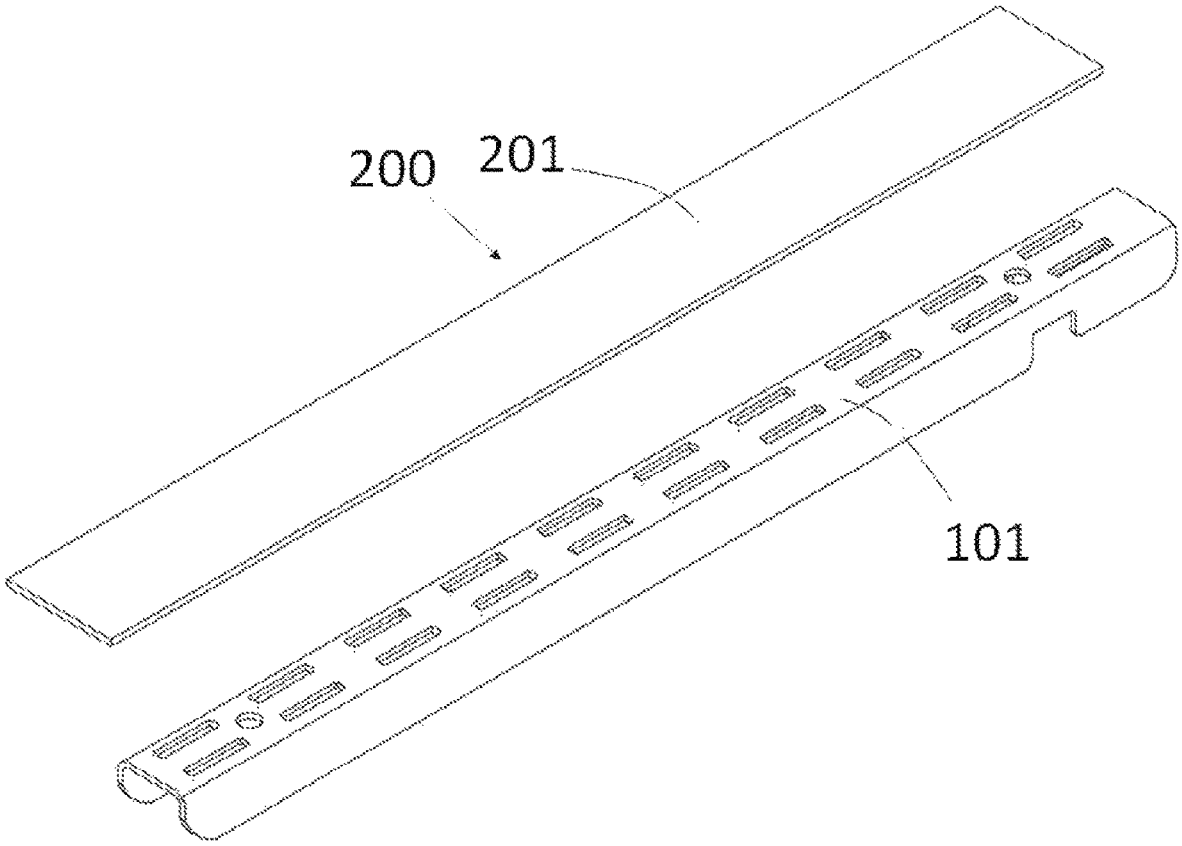
FIG. 2 is a schematic exploded view of a trim and a vertical beam in Embodiment 1.

As shown in FIG. 2, a trim 200 provided in the present application comprises a body 201. The body 201 is in a long strip shape as a whole and can be covered on a front panel 101 of the vertical beam 100. The trim 200 may be an injection molded piece containing a magnetic material. Specifically, during a manufacturing process, a magnetic material is added to raw materials for injection molding, and the magnetic material may be selected as magnetic powders. When the trim 200 comes into contact with the vertical beam 100, a magnetic force is generated between the trim 200 and the vertical beam 100, so that the trim 200 is attracted to the vertical beam 100. The trim 200 made of a magnetic material is convenient for installation and disassembly.

Figure 3:
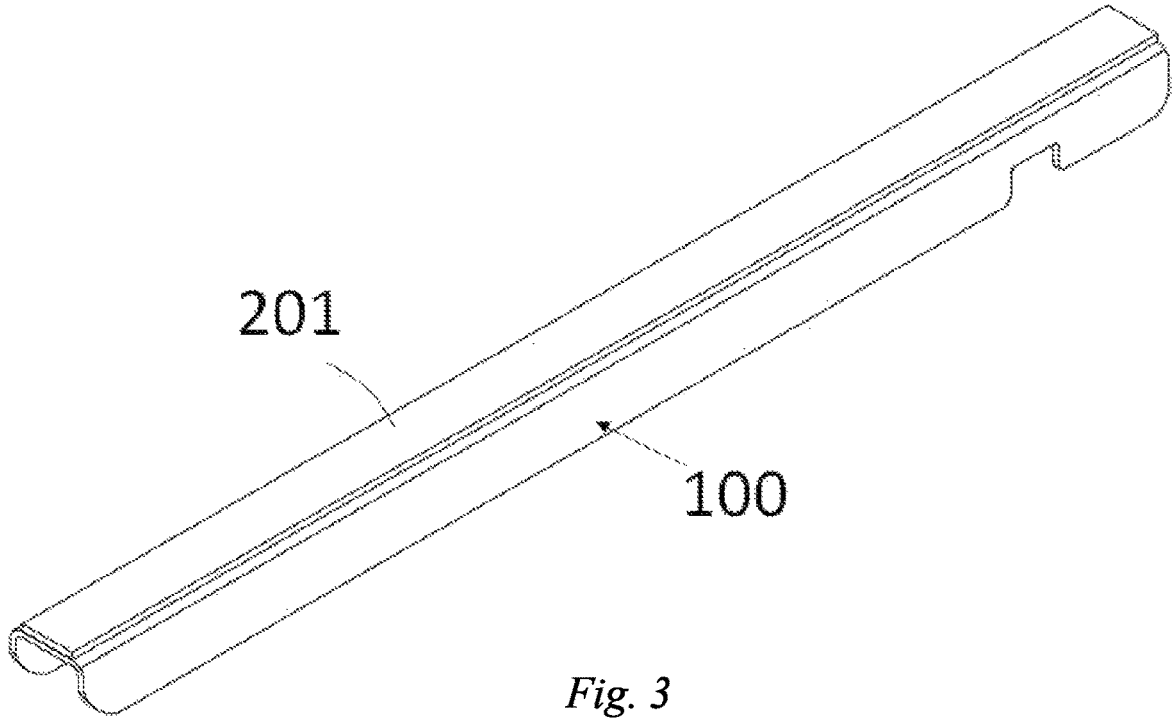
FIG. 3 is a schematic installation view of a trim and a vertical beam in Embodiment 1.

As shown in FIG. 3, the width of the body 201 of the trim 200 may be substantially equal to the width of the front panel 101 of the vertical beam 100, or the width of the body 201 of the trim 200 is slightly less than the width of the front panel 101, but the width of the body 201 is sufficient to enable the body 201 to shield slotted holes 104. The width here refers to the size of the trim 200 and the vertical beam 100 in the transverse direction, and the width referred to below has the same meaning as the width here. The trim 200 is covered on the front panel 101 of the vertical beam 100, and can be substantially as wide as the front panel 101 of the vertical beam 100, thereby shielding the front panel 101.

Figure 4:
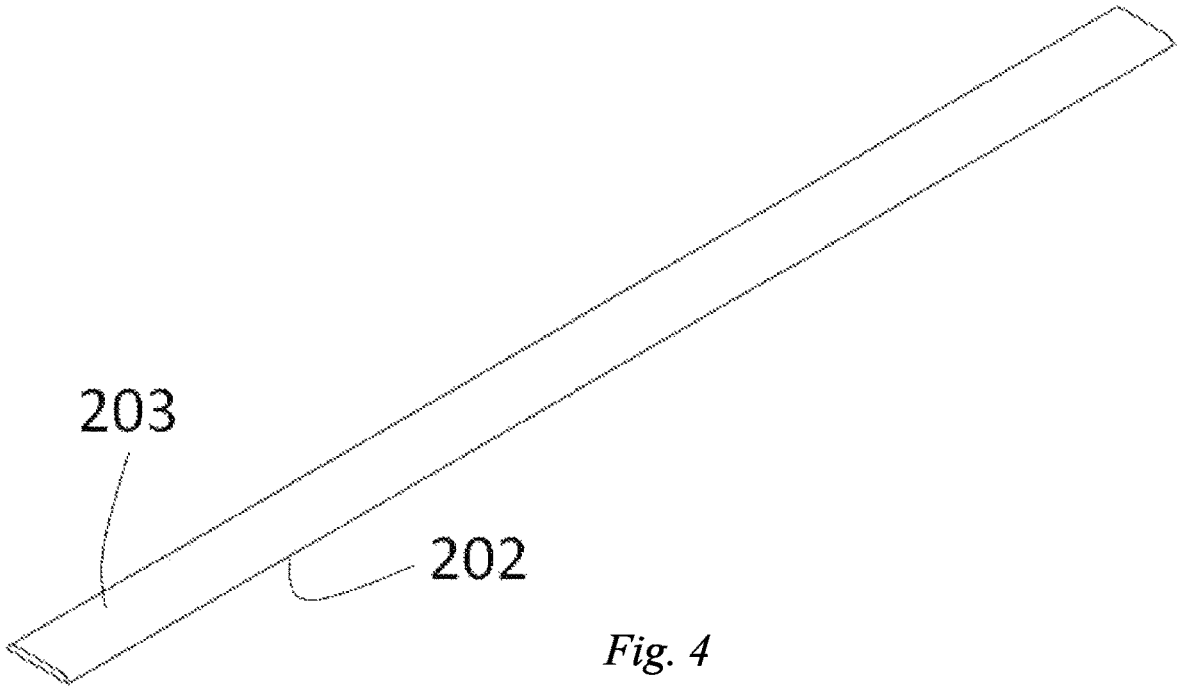
FIG. 4 is a schematic structural view of another trim in Embodiment 1.
Figure 6:
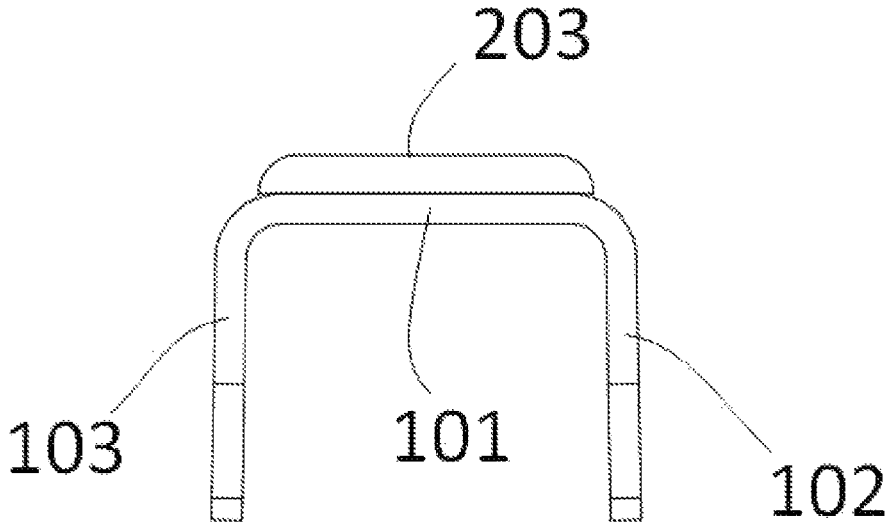
FIG. 6 is a schematic cross-section view of the trim shown in FIG. 4 installed on a vertical beam.

In some embodiments, as shown in FIG. 4, the body 201 of the trim 200 has a first surface 202 and a second surface 203, and the first surface 202 and the second surface 203 are oppositely provided. As shown in FIG. 6, the first surface 202 is used to be contacted with the front panel 101 of the vertical beam 100. The width of the first surface 202 is substantially the same as the width of the front panel 101, or the width of the first surface 202 is less than the width of the front panel 101 but sufficient to enable the first surface 202 to shield the slotted holes 104. The second surface 203 is an exposed surface of the trim 200 after being covered on the front panel 101.

Figure 5:
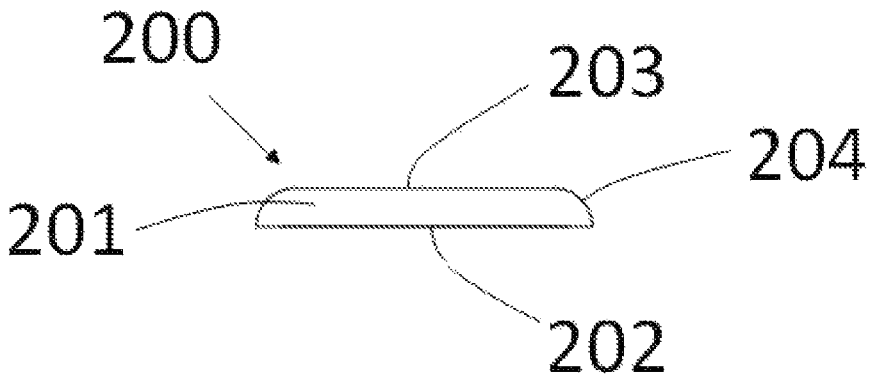
FIG. 5 is a schematic cross-section view of the trim shown in FIG. 4.

Preferably, as shown in FIG. 5, the width of the second surface 203 may be slightly less than the width of the first surface 202. The transition between the second surface 203 and the first surface 202 may be implemented by means of a chamfered corner, a rounded corner 204, or the like. Therefore, the cross-section of the body 201 is substantially trapezoidal. In this way, there will be no sharp edge and corner that may hurt people, the aesthetics of the product is also increased, and the material of the trim 200 may be saved as well.

The length of the trim 200 can be set according to an actual need, which does not constitute a limitation to the present application.

Figure 8:
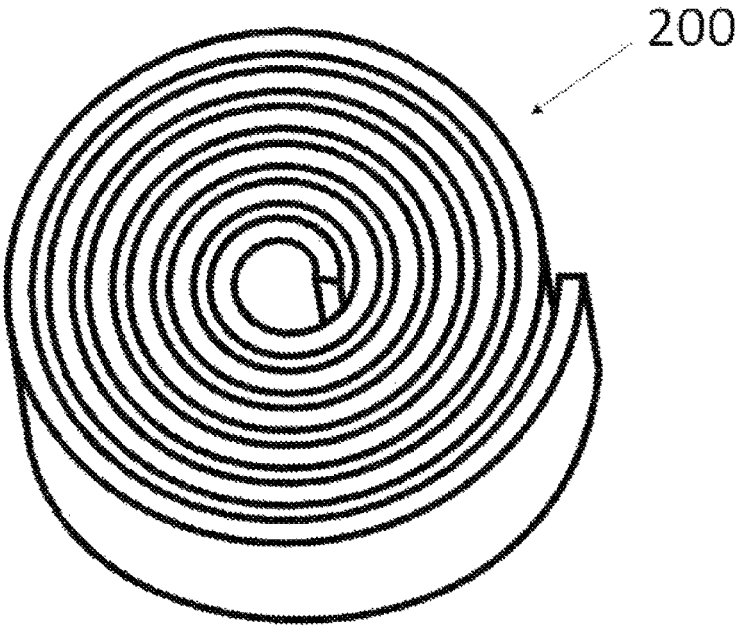
FIG. 8 is a schematic view of a trim after being rolled up.

The trim 200 may be made of a soft material. In an unused state, as shown in FIG. 8, the trim 200 may be rolled up to form a cylinder, so as to save space and facilitate storage and transportation.

Figure 7:
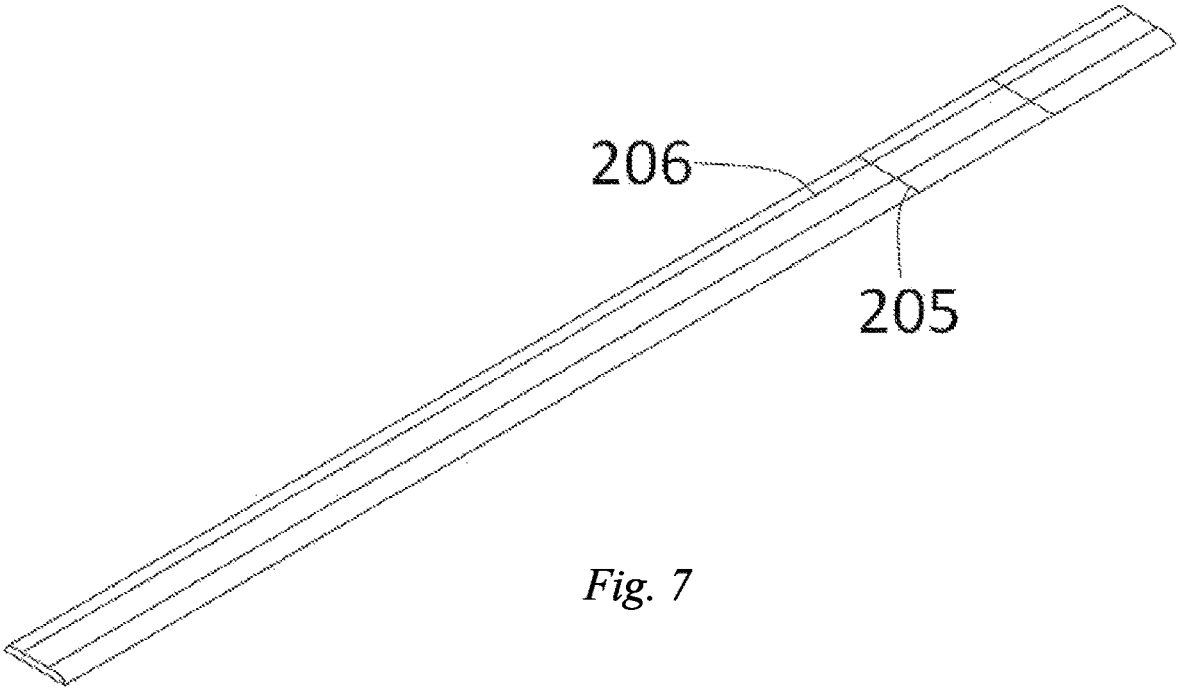
FIG. 7 is a schematic view of a first tear line and a second tear line.

In some embodiments, as shown in FIG. 7, at least one first tear line 205 may be arranged along the length direction of the trim 200, so that the trim 200 may be broken along the first tear line 205 to obtain trims 200 of different lengths, thus enabling the trim 200 to be suitable for a variety of scenarios with different size requirements. In some embodiments, at least one second tear line 206 may be arranged along the width direction of the trim 200, and the trim 200 may be broken along the second tear line 206 to obtain trims 200 of different widths. In some embodiments, the first tear line 205 and the second tear line 206 may be provided at the same time. The first tear line 205 and the second tear line 206 may be provided on the first surface 202 or the second surface 203 of the body 201.

The tear line is conducive for a user to conveniently break the trim, and the flatness of a fracture can be ensured without additional tools. The tear line may also be marked with size specifications, which is helpful for the user to perform cutting according to an actual need.

Embodiment 2

Figure 9:
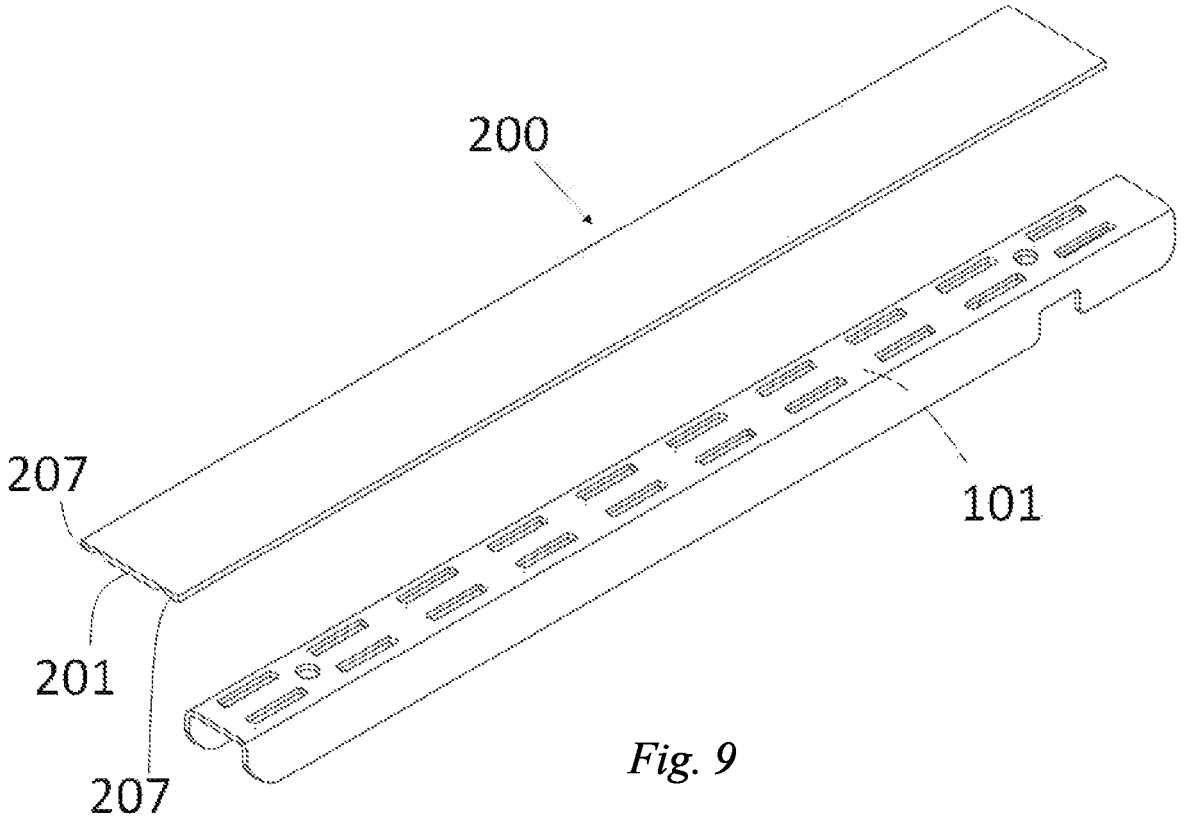
FIG. 9 is a schematic exploded view of a trim and a vertical beam in Embodiment 2.
Figure 10:
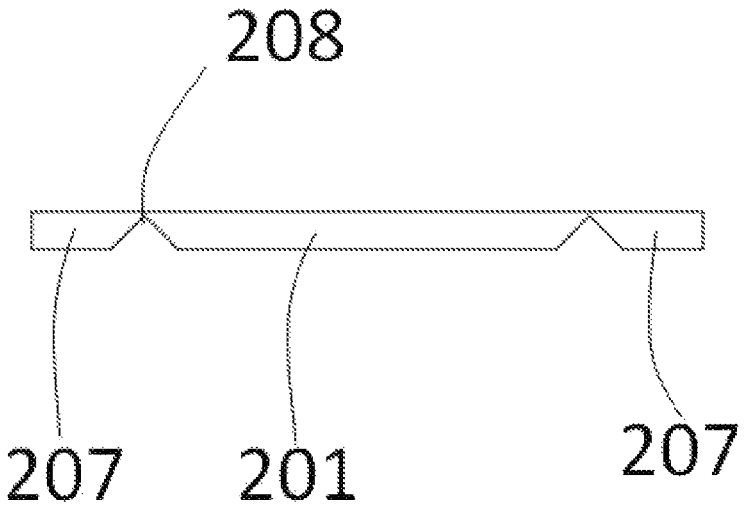
FIG. 10 is a schematic cross-section view of a trim in an unfolded state in Embodiment 2.

As shown in FIG. 9, compared with Embodiment 1, a trim 200 in this embodiment is based on the trim 200 of Embodiment 1, and a wing edge 207 is provided on at least one side of the body 201 of the trim 200 along the length direction. Specifically, in this embodiment, the trim 200 is in a long strip shape and comprises a body 201 and at least one wing edge 207. The shape of the body 201 is the same as that in Embodiment 1, and will not be repeated here. As shown in FIG. 10, a wing edge 207 is connected to one side of the body 201 along the length direction of the body 201, a first connecting portion 208 is provided between the wing edge 207 and the body 201, and the wing edge 207 is able to rotate around the first connecting portion 208 relative to the body 201.

The wing edge 207 and the body 201 may be integrally formed. An extrusion molding process is used to facilitate formation of the shape of the first connecting portion 208, and the shape of the first connecting portion 208 may be conveniently configured according to a need, so that the first connecting portion, after being folded, forms different angles, so as to adapt to vertical beams of different shapes.

The first connecting portion 208 is V-shaped with an opening end facing a vertical beam 100 and a top end being away from the vertical beam 100, so that when the wing edge 207 is unfolded, the surface of the wing edge 207 away from the vertical beam 100 and the second surface of the body 201 may form a plane. With regard to the V-shape of the first connecting portion 208, an angle is formed at the top end, and different angle magnitudes make angles of different magnitudes formed between the body 201 and the wing edge 207 after being folded, so as to adapt to vertical beams of different shapes. The magnitude of the angle may be set according to an actual need, and its specific value does not constitute a limitation to the present application.

Similar to Embodiment 1, the trim 200 in Embodiment 2 may be an injection molded piece containing a magnetic material. The length of the trim may be set according to an actual need, or a plurality of first tear lines 205 may be arranged along the length direction. The trim 200 may be made of a soft material, which is convenient for being rolled up and convenient for transportation and storage. At the same time, at least one second tear line 206 may be provided on the wing edge 207 to adjust the width of the wing edge 207.

In this embodiment, the wing edge 207 has two states: an unfolded state and a folded state. In the unfolded state, the wing edge 207 is flush with the body 201, that is, the wing edge 207 and the body 201 are in the same plane; and in the folded state, the wing edge 207 and the body 201 form an angle.

Figure 11:
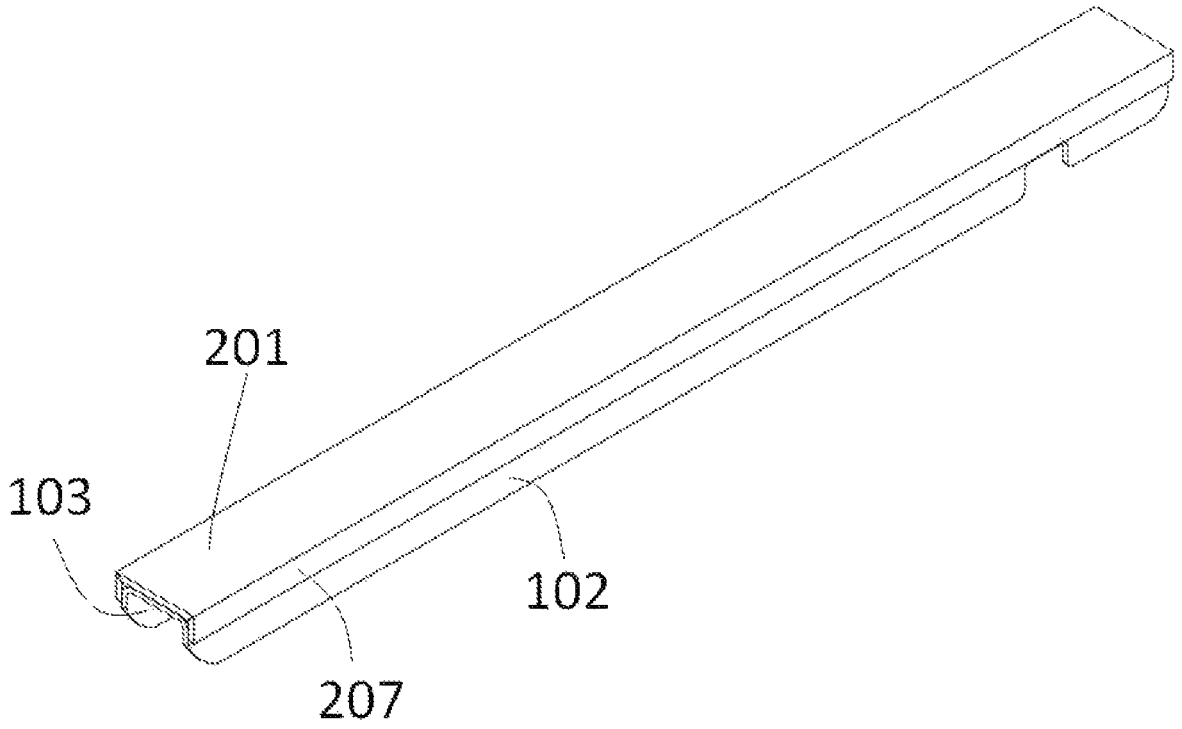
FIG. 11 is a schematic structural view of a trim installed on a vertical beam in Embodiment 2.
Figure 12:
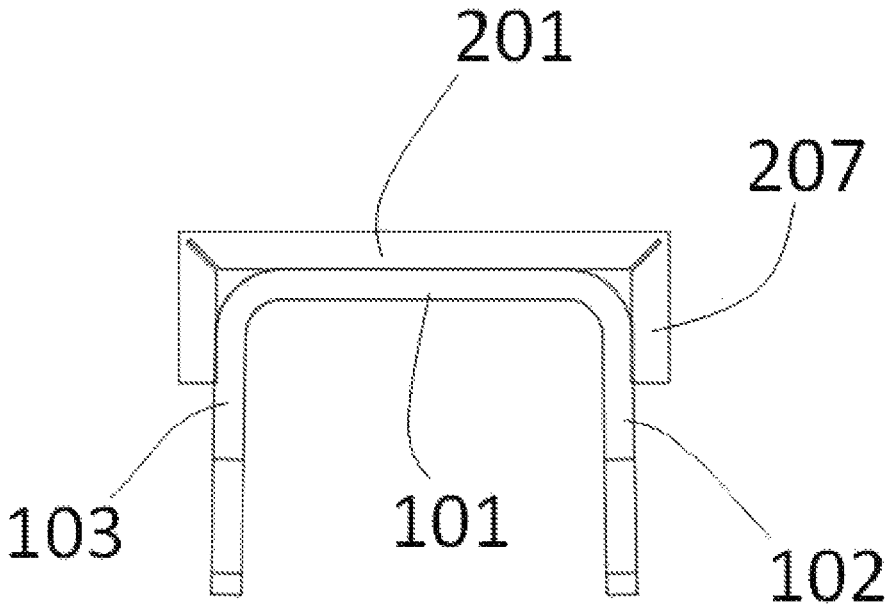
FIG. 12 is a schematic cross-section view of FIG. 10.

By providing at least one wing edge 207, the applicable scope of the width of the trim 200 is expanded. For example, as shown in FIGS. 11 and 12, when the width of a front panel 101 of the vertical beam 100 is the same as the width of the body 201, the body 201 may be covered on the front panel 101 of the vertical beam 100, and then the wing edge 207 is rotated toward a side surface of the vertical beam 100, that is, the wing edge 207 is in a folded state, such that the wing edge 207 is covered on the side surface of the vertical beam 100. When the width of the front panel 101 of the vertical beam 100 is greater than the width of the body 201, the wing edge 207 may be rotated to the same plane as the body 201, that is, the wing edge 207 is in an unfolded state, such that the trim 200 is covered on the front panel 101 of the vertical beam 100. The vertical beam 100 of the wing edge 207 may be set to one or two. The width of the wing edge 207 may be equal to or less than the width of the first side surface 102 or the second side surface 103 of the vertical beam 100.

In addition, when the wing edge 207 is covered on the side surface of the vertical beam 100, the magnetic force between the trim 200 and the vertical beam 100 may also be increased, thereby improving the connection strength of the trim 200.

The design of one or two wing edges 207 may effectively prevent the trim 200 from moving transversely on the vertical beam 100.

Embodiment 3

Figure 13:
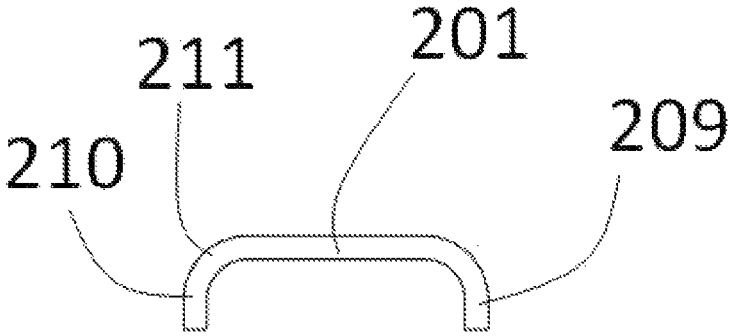
FIG. 13 is a schematic cross-section view of a trim in Embodiment 3.

As shown in FIG. 13, compared with Embodiment 1, a trim 200 in this embodiment is based on the trim 200 in Embodiment 1. The body 201 of the trim 200 is provided with two side edges along the length direction, that is, a first side edge 209 and a second side edge 210, wherein the first side edge 209 and the second side edge 210 respectively form an angle with the body 201. Preferably, the first side edge 209 and the second side edge 210 are perpendicular to the body 201, such that the cross-section of the trim 200 is substantially U-shaped. Second connecting portions 211 between the two side edges and the body 201 may be provided in arc shapes.

Other technical features in Embodiment 1, for example, the structure of the body 201, being made of a magnetic material, being made of a soft material, having a first tear line 205 and a second tear line 206, etc., may all be applied to this embodiment.

Figure 14:
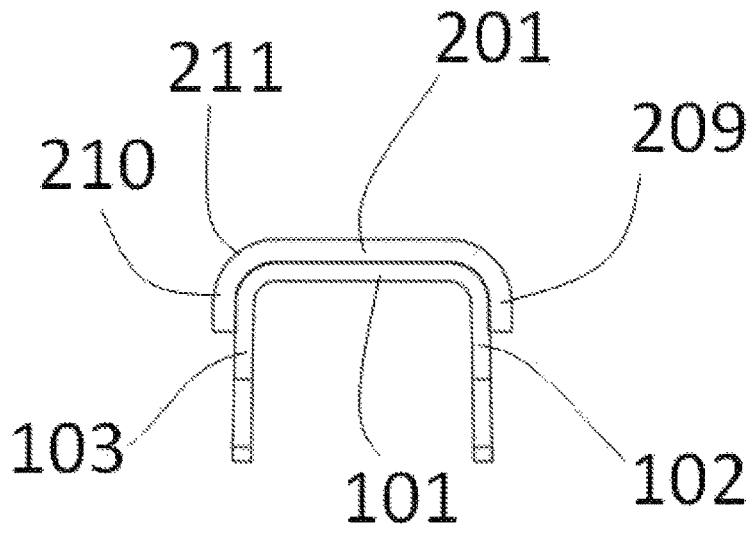
FIG. 14 is a schematic cross-section view of a trim installed on a vertical beam in Embodiment 3.

As shown in FIG. 14, when the trim 200 in this embodiment is in use, the body 201 is still covered on a front panel 101 of a vertical beam 100, and the two side edges are covered on a first side surface 102 and a second side surface 103 of the vertical beam 100, respectively. Specifically, after a user finishes installing a shelving system, unused slotted holes 104 on the vertical beam 100 will be exposed. The user may select a desired trim 200 according to the size of the exposed slotted holes 104 to shield the exposed slotted holes 104. By doing so, the aesthetics of the product may be increased. At the same time, a situation that other items are inserted into the vertical beam 100 and are hooked on the vertical beam 100 can be avoided.

Embodiment 4

Figure 15:
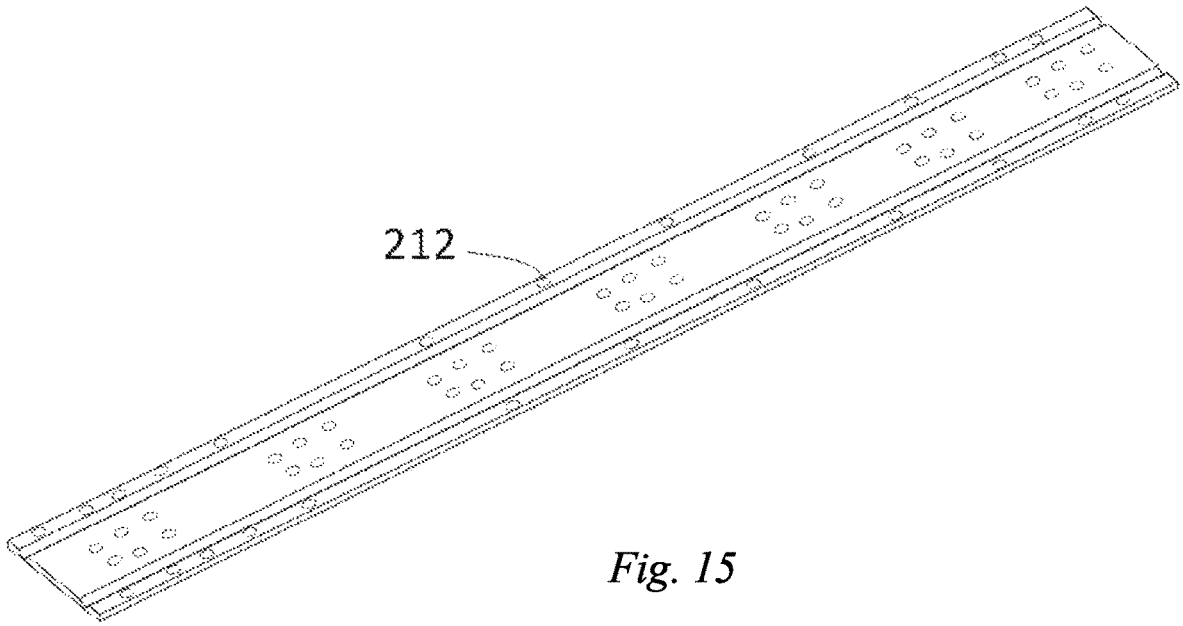
FIG. 15 is a schematic view of a trim including magnetic portions in Embodiment 4.

In Embodiments 1, 2 and 3, the trim 200 is an injection molded piece containing a magnetic material. Compared with Embodiments 1, 2 and 3, as shown in FIG. 15, a trim 200 in this embodiment can be made of other suitable soft materials as a whole, and then a plurality of magnetic portions 212 made of magnetic materials are provided on the trim 200. The trim 200 is attracted to the vertical beam 100 by using the magnetic portions 212. The magnetic portions 212 may be uniformly arranged on the trim 200, or a plurality of magnetic portions 212 may be concentratedly provided on a part where the force is concentratedly received. The magnetic portions 212 are fixed on the trim 200 so as to be integrated with the trim 200.

It should be understood that the structure of the trim 200 in Embodiment 4 may be the structure in any of Embodiments 1, 2, and 3. The only difference lies in the different materials used in the whole trim 200 and the addition of the magnetic portions 212.

Embodiment 5

Figure 16:
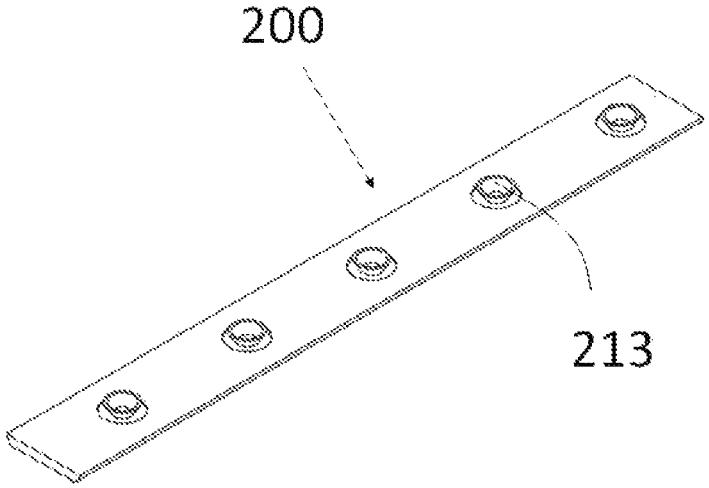
FIG. 16 is a schematic view of a trim comprising a suction component in Embodiment 5.

As shown in FIG. 16, the difference between this embodiment and Embodiment 4 is that the magnetic portions 212 is replaced by suction components. When the suction components come into contact with the vertical beam 100, the suction components are pressed to squeeze out the air, thereby forming a negative pressure to fix the trim 200 on the vertical beam 100. The suction components may be uniformly arranged on the trim 200, or a plurality of suction components 213 may be concentratedly provided on a part where the force is concentratedly received, and the suction components 213 may be suction cups. However, it should be noted that when the suction components 213 are provided on the trim 200, pay attention to avoid positions corresponding to the slotted holes 104 of the vertical beam 100. The magnetic portions 212 are fixed on the trim 200 so as to be integrated with the trim 200.

It should be understood that the structure of the trim 200 in Embodiment 5 may be the structure in any of Embodiments 1, 2, and 3. The trim 200 in Embodiment 5 may also be made of a magnetic material, and then the suction components 213 are provided, so that the force between the trim 200 and the vertical beam 100 may be further enhanced to improve the connection strength between the two. Alternatively, the magnetic portions 212 may be further provided on the trim 200 in Embodiment 5, such that the magnetic portions 212 and the suction components 213 exist simultaneously.

Embodiment 6

Figure 17:
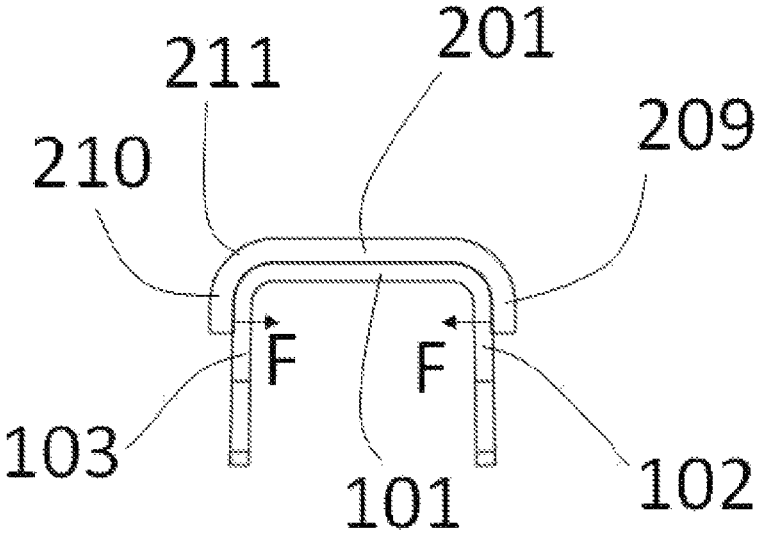
FIG. 17 is a schematic elastic force view in Embodiment 6.

This embodiment is improved on the basis of Embodiment 3, that is, a trim 200 in this embodiment is substantially the same as the structure of the trim 200 in Embodiment 3, both of which have a body 201 and two side edges. The difference is that the trim 200 in Embodiment 6 has elasticity, that is, the spacing between the two side edges will change under the action of an external force, and when the external force disappears, the two side edges will return to an original state. The spacing between the two side edges in the original state is less than the width of the vertical beam 100. When the trim 200 is being installed, the two side edges are spread apart, then the vertical beam 100 is sleeved with the trim, and then the external force is released such that the trim 200 is deformed. As shown in FIG. 17, elastic forces F are generated. The elastic forces F cause the two side edges to move toward the vertical beam 100 respectively, so that the elastic forces F are used to clamp the trim 200 on the vertical beam 100.

In this embodiment, the whole trim 200 may be made of a magnetic material, and the trim 200 has elasticity, thereby generating magnetic forces and clamping forces, which further improves the connection strength between the trim 200 and the vertical beam 100. It may also be made of a non-magnetic material, and the trim 200 has elasticity, thereby generating clamping forces. It is also possible to provide magnetic portions 212 and/or suction components on the trim 200.

Embodiment 7

Figure 18:
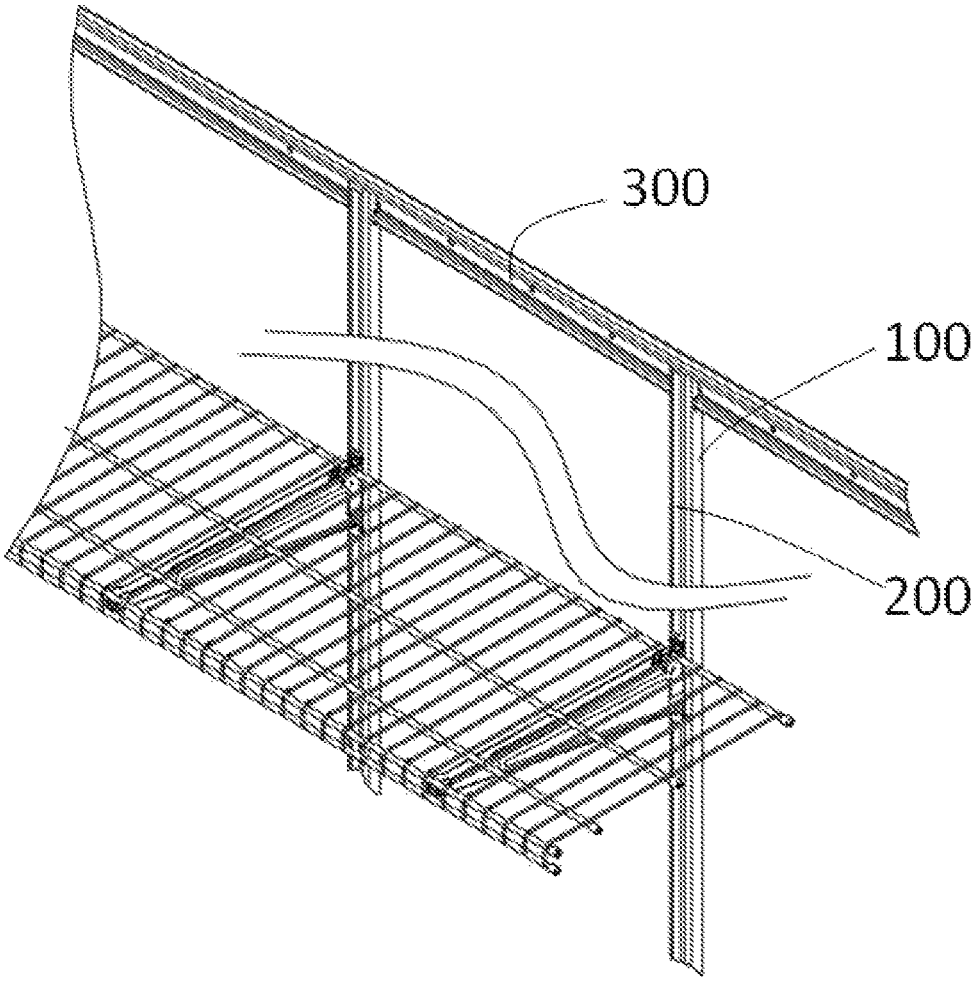
FIG. 18 is a schematic structural view of a shelving system.
Figure 19:
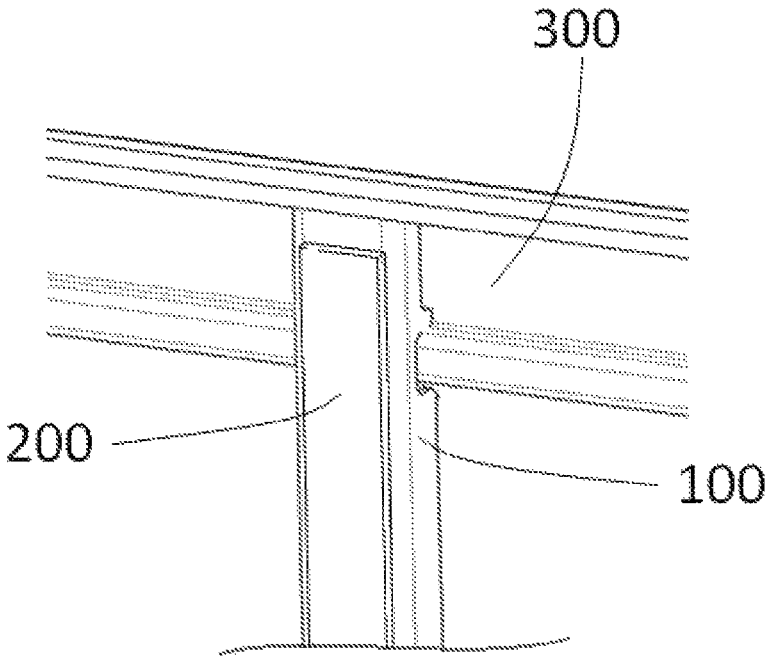
FIG. 19 is a partial enlarged view of the shelving system of FIG. 18.

As shown in FIGS. 18 and 19, in this embodiment, a shelving system is provided, which comprises a horizontal beam 300, a vertical beam 100, and a trim 200.

The horizontal beam 300 is generally used to be connected to a vertical surface, to play a role of fixing the whole shelving system.

The vertical beam 100 is connected to the horizontal beam 300 and may be fixed on the horizontal beam 300 by fasteners. Suspension elements may be provided on the vertical beam 100.

The trim 200 is covered on at least part of the surface of the vertical beam 100. The trim 200 may be a trim with any structure in Embodiments 1-6. Preferably, in this embodiment, the trim 200 is made of a magnetic material and is attracted to the vertical beam 100 by magnetic forces.

The preferred embodiments of the present application are described in detail above. It should be understood that those of ordinary skills in the art may make many modifications and changes according to the concept of the present application without creative work. Therefore, all technical solutions that can be obtained by those skilled in the art through logical analysis, reasoning or limited experiments based on the concept of the present application and the prior art should fall within the scope of protection defined by the claims.

The invention claimed is:

1. A trim for being covered on a vertical beam of a shelving system, wherein the trim is matched with the shape of the vertical beam, and the trim is configured such that when the trim is covered on the vertical beam, a force is generated between the trim and the vertical beam, the trim is fixed on the vertical beam with the force and the trim is covered on at least part of the surface of the vertical beam;

wherein the trim comprises a body, the body is in a long strip shape, the shape of the body is matched with a front panel, with slotted holes, of the vertical beam, and the body is configured to be covered on the front panel of the vertical beam;

the trim further comprises a first side edge and a second side edge, the first side edge and the second side edge are respectively connected to two opposite sides of the body along its length direction, the first side edge and the second side edge protrude outward from the body, and a distance between the first side edge and the second side edge is less than a width of the vertical beam in an original state, and the first side edge and the second side edge are configured such that the distance between the first side edge and the second side edge changes under an action of an external force, and the distance returns to the original state when the external force disappears; and the trim further comprises suction components, wherein when the suction components come into contact with the vertical beam, the suction components are pressed to squeeze out air, thereby forming a negative pressure to fix the trim on the vertical beam;

wherein the body of the trim is provided with the suction components, and the suction components are suction cups;

wherein the first side edge and the second side edge of the trim are provided with a plurality of projecting magnetic portions made of magnetic materials.

2. The trim of claim 1, which is an injection molded piece containing a magnetic material.

3. The trim of claim 1, wherein the body comprises a first surface and a second surface that are oppositely provided, the width of the first surface is greater than the width of the second surface, and the first surface is configured to be in contact with the front panel of the vertical beam.

4. The trim of claim 1, wherein the first side edge and the second side edge are respectively connected to the body through connecting portions.

5. The trim of claim 4, wherein the connecting portions are in arc shapes.

6. The trim of claim 1, wherein the trim is provided with at least one first tear line, the first tear line is perpendicular to the length direction of the trim, and the trim is configured to be able to be broken along the first tear line under the action of an external force.

7. The trim of claim 1, wherein the trim is provided with at least one tear line, the tear line is parallel to the length direction of the trim, and the trim is configured to be able to be broken along the tear line under the action of an external force.

8. The trim of claim 1, wherein the trim is configured that when the first side edge and the second side edge come into contact with the vertical beam, the distance between the first side edge and the second side edge changes, thereby the first side edge and the second side edge are clamped on the vertical beam.

9. The trim of claim 1, wherein the trim is flexible, and the trim is configured to be able to be rolled up to form a cylinder.

10. A vertical beam assembly, comprising:

a vertical beam which comprises a front panel and two side surfaces, wherein the two side surfaces are respectively located on two opposite sides of the front panel along its length direction, such that the cross-section of the vertical beam is U-shaped; and a trim which is covered on at least part of the surface of the vertical beam, wherein the trim is configured such that by using a force generated by contact between the trim and the vertical beam, the trim is fixed on the vertical beam;

wherein the trim comprises a body, the body is in a long strip shape, the shape of the body is matched with a front panel, with slotted holes, of the vertical beam, and the body is configured to be covered on the front panel of the vertical beam;

the trim further comprises a first side edge and a second side edge, the first side edge and the second side edge are respectively connected to two opposite sides of the body along its length direction, the first side edge and the second side edge protrude outward from the body, and a distance between the first side edge and the second side edge is less than a width of the vertical beam in an original state, and the first side edge and the second side edge are configured such that the distance between the first side edge and the second side edge changes under an action of an external force, and the distance returns to the original state when the external force disappears; and the trim further comprises suction components, wherein when the suction components come into contact with the vertical beam, the suction components are pressed to squeeze out air, thereby forming a negative pressure to fix the trim on the vertical beam;

wherein the body of the trim is provided with the suction components, and the suction components are suction cups;

wherein the first side edge and the second side edge of the trim are provided with a plurality of projecting magnetic portions made of magnetic materials.

11. The vertical beam assembly of claim 10, wherein at least part of the trim is made of a magnetic material.

12. The vertical beam assembly of claim 10, wherein the trim is configured that when the first side edge and the second side edge come into contact with the vertical beam, the distance between the first side edge and the second side edge changes, thereby the first side edge and the second side edge are clamped on the vertical beam.

13. A shelving system, comprising:

a horizontal beam;

a vertical beam which is connected to the horizontal beam; and a trim which is covered on at least part of the surface of the vertical beam, wherein the trim comprises a body, the body is in a long strip shape, the shape of the body is matched with a front panel, with slotted holes, of the vertical beam, and the body is configured to be covered on the front panel of the vertical beam;

the trim further comprises a first side edge and a second side edge, the first side edge and the second side edge are respectively connected to two opposite sides of the body along its length direction, the first side edge and the second side edge protrude outward from the body, and a distance between the first side edge and the second side edge is less than a width of the vertical beam in an original state, and the first side edge and the second side edge are configured such that the distance between the first side edge and the second side edge changes under an action of an external force, and the distance returns to the original state when the external force disappears; and the trim further comprises suction components, wherein when the suction components come into contact with the vertical beam, the suction components are pressed to squeeze out air, thereby forming a negative pressure to fix the trim on the vertical beam;

wherein the body of the trim is provided with the suction components, and the suction components are suction cups;

wherein the first side edge and the second side edge of the trim are provided with a plurality of projecting magnetic portions made of magnetic materials.

* * * * *